US005837437A

United States Patent [19]

Sharma et al.

[11] Patent Number: 5,837,437

[45] **Date of Patent: *Nov. 17, 1998**

[54] DIFFUSIONAL FLUX CONTROL OF SOLUBLE COMPONENTS IN PHOTOGRAPHIC ELEMENTS

[75] Inventors: Ravi Sharma, Fairport; John Texter, Rochester, both of N.Y.

[73] Assignee: Eastman Kodak Company, Rochester, N.Y.

[ * ] Notice: The term of this patent shall not extend beyond the expiration date of Pat. No. 5,370,967.

[21] Appl. No.: 614,428

[22] Filed: Mar. 12, 1996

Related U.S. Application Data

[60] Provisional application No. 60/000,566, Jun. 26, 1995.

[51] Int. Cl. [6] ..... G03C 1/42; G03C 1/76

[52] U.S. Cl. ..... 430/537; 430/215; 430/523; 430/536; 430/539; 430/959; 430/961; 430/404; 430/403

[58] Field of Search ..... 430/215, 539, 430/961, 954, 523, 537, 536

[56] References Cited

U.S. PATENT DOCUMENTS

| | | | |
|---|---|---|---|
| 4,298,682 | 11/1981 | Bishop | 430/215 |
| 4,369,245 | 1/1983 | Beruto et al. | 430/539 |
| 4,409,322 | 10/1983 | Ezaki et al. | 430/523 |
| 4,508,818 | 4/1985 | Ogawa et al. | 430/523 |
| 4,734,353 | 3/1988 | Ono et al. | 430/236 |
| 4,861,702 | 8/1989 | Suzuki et al. | 430/564 |
| 5,061,595 | 10/1991 | Gingello et al. | 430/264 |
| 5,066,569 | 11/1991 | Nagashima et al. | 430/393 |
| 5,166,043 | 11/1992 | DePrijcker | 430/539 |
| 5,206,128 | 4/1993 | Arai | 430/539 |
| 5,210,007 | 5/1993 | Texter et al. | 430/373 |
| 5,240,821 | 8/1993 | Texter et al. | 430/405 |
| 5,256,525 | 10/1993 | Southby et al. | 430/959 |
| 5,272,046 | 12/1993 | Sasaoka | 430/453 |
| 5,342,743 | 8/1994 | Goto et al. | 430/507 |
| 5,366,855 | 11/1994 | Anderson et al. | 430/530 |
| 5,370,967 | 12/1994 | Texter et al. | 430/215 |
| 5,411,840 | 5/1995 | Texter et al. | 430/380 |

*Primary Examiner*—Richard L. Schilling
*Attorney, Agent, or Firm*—Paul A. Leipold

[57] ABSTRACT

An aqueous developable chromogenic photographic element coated on a single dimensionally stable support wherein said element comprises in reactive association (1) an aqueous diffusible photographically useful organic compound or precursor to an aqueous diffusible photographically useful organic compound, (2) radiation sensitive silver halide, (3) a compound that forms or releases a dye, (4) hydrophilic binder, and (5) one or more contiguous overcoat layers devoid of silver halide wherein said one or more overcoat layers comprise hydrophilic binder at a level of at least 3 $g/m^2$ is disclosed.

18 Claims, No Drawings

DIFFUSIONAL FLUX CONTROL OF SOLUBLE COMPONENTS IN PHOTOGRAPHIC ELEMENTS

CROSS REFERENCE TO RELATED APPLICATION

Reference is made to and priority claimed from U.S. provisional application Serial No. U.S. Ser. No. 60/000,566, filed 26 Jun. 1995, entitled DIFFUSIONAL FLUX CONTROL OF SOLUBLE COMPONENTS IN PHOTOGRAPHIC ELEMENTS.

RELATED APPLICATION

This application is related to copending, commonly assigned U.S. application Ser. No. 8/342,983 of Buchanan et al., Blocked Photographically Useful Compounds for use with Peroxide-Containing Processes, filed Nov. 21, 1994, now U.S. Pat. No. 5,538,834.

FIELD OF THE INVENTION

This invention relates to photographic systems and processes for developing images in light sensitive silver halide photographic elements. More particularly this invention relates to use of thick protective overcoat layers to control swelling and drying when using low volumes of processing solutions in the development of silver halide photographic elements, and the use of such protective overcoats in controlling the transient diffusion of soluble organic components incorporated in such elements.

BACKGROUND OF THE INVENTION

H. Iwano, in an article entitled The Penetration Rate of Photographic Chemicals into Gelatin Layers and into Emulsion Layers under Development, published in *The Journal of Photographic Science*, volume 20, pages 135–142, 1972, presents diffusion coefficients for various developers and couplers in swollen gelatin under various conditions.

Sato et al. in U.S. Pat. No. 4,409,323 disclose a photographic material containing a coupler capable of releasing a photographically useful group with controlled timing. Ono et al. in U.S. Pat. No. 4,734,353 disclose precursors to various photographically useful compounds, wherein development inhibitors, dyes, stabilizers, bleach accelerators, and electron transfer agents are chemically blocked and the incorporation of such precursors in photographic elements. Release of the diffusible photographically useful groups and compounds is obtained after processing the photographic element in a solution containing an oxime. Buchanan et al. in U.S. Pat. No. 5,019,492 disclose photographic elements containing blocked photographically useful organic compounds. Szajewski and Taber in U.S. Pat. No. 5,021,555 disclose color photographic materials that contain a development inhibitor releasing compound. Buchanan et al. in European Patent Application EP 0 547 707 A1 and in provisional Japanese unexamined Kokai No. 5-249603 disclose blocked photographically useful compounds for use with peroxide-containing processes.

The incorporation of developers and developer precursors in photographic elements has been disclosed by Matejec et al. in German Offenlegungsschrift 40 20 058 A1, by Reeves in U.S. Pat. No. 3,342,599, by Schleigh and Faul in *Research Disclosure* (volume 129, pp. 27–30, 1975), by Waxman and Mourning in U.S. Pat. No. 4,060,418, by Hamaoka et al. in U.S. Pat. No. 4,157,915, by Kajiwara et al. in U.S. Pat. No. 4,371,609, by Buchanan et al. in U.S. Pat. No. 5,019,492 and by Nakagawa et al. in U.S. Pat. No. 5,043,254. Matejec et al. disclose the incorporation of ballasted paraphenylenediamines in multilayer chromogenic elements. Reeves discloses the use of Schiff-base developer precursors. Schleigh and Faul describe the quaternary blocking of color developers and the acetamido blocking of paraphenylenediamines. Hamaoka et al. and Waxman and Mourning describe the preparation and use of carbamate-blocked paraphenylenediamines. Kajiwara et al. disclose the incorporation of paraphenylenediamines in photographic elements and the development of said elements using hydrogen peroxide assisted amplification. Buchanan et al. describe the preparation of β-ketoacyl-blocked paraphenylenediamines. Nakagawa et al. disclose the incorporation of ballasted p-phenylenediamines in color photographic elements to reduce processing time and to improve processing variability.

Buchanan et al. in U.S. application Ser. No. 8/342,983 filed Nov. 21, 1994 entitled Blocked Photographically Useful Compounds for use with Peroxide-Containing Processes now U.S. Pat. No. 5,538,834, Texter et al. in U.S. Pat. No. 5,210,007, Southby et al. in U.S. Pat. No. 5,256,525, and Texter et al. in U.S. Pat. No. 5,240,821 disclose the advantageous incorporation of a variety of developers and developer precursors in photographic elements.

Bishop, in U.S. Pat. No. 4,298,682, discloses a photographic element having an overcoat of ionic polyester in hydrophilic colloid. Good results are described as obtained at coverages ranging from 0.27 to 2.6 g/m$^2$ of polyester for 0.27 g/m$^2$ of hydrophilic colloid such as gelatin.

Ezaki and Murakami, in U.S. Pat. No. 4,409,322, disclose silver halide photosensitive material with 0.1–3 μm thick overcoats.

Ogawa et al., in U.S. Pat. No. 4,508,818, disclose silver halide photographic sensitive materials with protective overcoats. It is disclosed that such overcoat layers should be as thin as possible. It is disclosed that a gelatin overcoat layer should have a thickness of less than 0.5 μm.

Suzuki et al., in U.S. Pat. No. 4,861,702, disclose silver halide material for rapid processing, wherein the amount of the gelatin contained in the hydrophilic layer or layers if this material is in the range of 1.9 to 3.5 g/m$^2$.

Gingello et al., in U.S. Pat. No. 5,061,595, disclose a contact film for use in graphic arts with two overcoat layers. This contact film is coated on a support having in order on one side (1) a radiation-sensitive layer comprising silver halide grains, a hydrophilic colloid and a polymer latex, (2) an interlayer comprising a hydrophilic colloid and a polymer latex, and (3) an overcoat layer comprising a hydrophilic colloid, a matting agent and a light-scattering agent, wherein the interlayer has a thickness in the range of 0.5 to 5 μm and is at least twice the thickness of the overcoat layer.

Nagashima, in U.S. Pat. No. 5,066,569, discloses an improved method of processing an imagewise exposed photographic material that has a gelatin content of not more than 3.0 g/m$^2$ in the constituent layers of this material.

De Prijcker, in U.S. Pat. No. 5,166,043, discloses a light-sensitive silver halide material that comprises at least one protective hydrophilic colloid layer having a thickness of 1 to 3 μm. Protective gelatin layers having gelatin coated therein at 2.4 g/m$^2$ are disclosed.

Arai, in U.S. Pat. No. 5,206,128, discloses a silver halide photographic material having a protective layer. The gelatin in this protective layer is in an amount of at least 1.5 g/m$^2$, the gelatin contained in the emulsion layer is in an amount of at least 1.0 g/m$^2$, and the coated amount of gelatin in the protective layer and the emulsion layer is a total of at most 3.5 g/m$^2$.

Sasaoka, in U.S. Pat. No. 5,272,046, discloses a silver halide photographic material, wherein the coated amount of the gelatin contained in the protective layer provided on the side of the silver halide emulsion layers of the material is 1.0 g/m$^2$ or less.

Goto and Inoue, in U.S. Pat. No. 5,342,743, disclose a silver halide photographic material comprising a light-insensitive hydrophilic colloid layer further distant from the support than the emulsion layer. The light-insensitive hydrophilic colloid layer contains at least a solid dye which is dispersed in the form of fine particles and further may contain a water double dye. Lower and upper protective layers are disclosed in the examples therein as coated with a total of 1.5 g/m$^2$ gelatin.

Anderson and Wang, in U.S. Pat. No. 5,366,855, disclose a photographic support comprising an antistatic layer and a protective overcoat. The protective overcoat is a layer of a coalesced layer of film-forming colloidal polymeric particles and non-film-forming colloidal polymeric particles. It is disclosed that the coatings are dried at temperatures up to 150° C. to give dried coating weights of about 100 mg/m$^2$ to 10 g/m$^2$.

Texter and Willis, in U.S. Pat. No. 5,411,840, disclose an aqueous developable chromogenic photographic element coated on a single dimensionally stable support wherein said element comprises in reactive association (1) a developing agent, where said developing agent is a primary amine or a precursor of a primary amine, (2) radiation sensitive silver halide, (3) a color coupler compound that forms or releases a dye upon reaction with the oxidation product of a primary amine developing agent, (4) a hydrophilic binder, and (5) one or more contiguous overcoat layers devoid of silver halide and devoid of developer or developer precursor wherein said overcoat layers comprise hydrophilic binder at a level of at least 3 g/m$^2$.

Methods of processing photographic materials utilizing low volumes of processing solutions have been developed by numerous workers for a variety of reasons. These reasons include the desire to minimize waste from the needless use of excessive quantities of processing solution, to minimize pollution and processing solution effluent, and to promote in general the concept of "single-use" chemistry, wherein a given quantity of processing solution is metered onto the substrate (photographic element) to be processed, and thereon totally consumed and/or thereafter discarded. Other motivation includes the need to have rapid processing of photographic elements. Such rapid processing systems, many of which offer low-volume attributes, may be classified according to a multi-tiered scheme as direct or indirect methods, methods using high-viscosity processing fluids and those using low-viscosity fluids, and the mode of application, including immersion, spraying, saturated and web transfer. Diffusion transfer of processing fluids is another general method suitable for applying low volumes.

In conventional processing of photographic elements, where said elements do not incorporate developer or developer precursor, the volume of developer solution that can be efficiently applied is controlled by the solubility of the developing agent in the developing solution. Such solutions typically are high in ionic strength. This solubility limitation is not a significant problem in black and white developing where the active developing agent is generally ionized and extremely water soluble at typical developer pH of 10–12. However, this solubility limitation poses a major problem in the case of color developers, such as primary amine developing agents like paraphenylenediamines, that exist at these pH as free bases of limited solubility.

PROBLEM TO BE SOLVED BY THE INVENTION

It has not previously been recognized that low volume processes for forming photographic images with elements that incorporate aqueous diffusible photographically useful organic compounds (PUC) and precursors to such compounds in reactive association with silver halide in said elements suffer inefficiencies from the uncontrolled transient swelling of such elements. These unwanted inefficiencies include unwanted seasoning and processing variability of processing solutions, low developed densities because of inefficient use of developer and developer precursors, and uncontrolled loss of aqueous diffusible PUC and precursors to such PUC from the photographic element before development has occurred.

SUMMARY OF THE INVENTION

It is an object of the present invention to provide an improved method of forming chromogenic photographic images with silver halide containing photographic elements. It is a further object of the present invention to provide a method that reduces the amount of incorporated aqueous diffusible photographically useful organic compounds (PUC) and precursors to such compounds that is wasted by unwanted diffusion of said compounds or precursors to said compounds out of said element. Yet another object of the present invention is to provide a photographic element that has a layer structure which minimizes deleterious effects of uncontrolled transient swelling.

These and other objects of the invention are generally accomplished by providing an aqueous developable chromogenic photographic element coated on a single dimensionally stable support wherein said element comprises in reactive association (1) an aqueous diffusible photographically useful organic compound or precursor to an aqueous diffusible photographically useful organic compound, (2) radiation sensitive silver halide, (3) a compound that forms or releases a dye, (4) hydrophilic binder, and (5) one or more contiguous overcoat layers devoid of silver halide wherein said one or more overcoat layers comprise hydrophilic binder at a level of at least 3 g/m$^2$.

ADVANTAGEOUS EFFECT OF THE INVENTION

The elements of the present invention greatly reduce variability in image performance arising from uncontrolled swelling of the element during development. The thick overcoat layers of the elements of the present invention buffer the chemistry during activation and development against premature quenching due to premature drying of the reacting layers in these elements.

DETAILED DESCRIPTION OF THE INVENTION

Two or more chemical components in a photographic element are "in reactive association" when said components can chemically interact with one another. This chemical interaction may occur when said element is wetted with processing fluid, and might not occur when said element is dry. Said interaction may occur in a dry element when said element is heated, or as the result of slow diffusion of one or more components in and through said element, even though said element is dry. However, the operative interaction may be by any chemical means or intermediary means wherein an effect on one component may be attributed to causation of said effect by another component. The phrase "in reactive association" generally refers to any two components in the same or different layers of a photographic element that may be connected by a chemical diffusion path, where said path does not exit said element.

The term "swell volume" is defined herein to mean, for a particular combination of processing solution and photographic element, the volume per unit area of processing solution imbibed into said element when said element is in contact with an excess of said solution and when said contact is in mechanical equilibrium. The term "applied volume" refers to the processing solution volume per unit area of photographic element that is applied by any of the means described or disclosed herein. Suitable means include applicator, coating, spraying, thin-film, thin-tank, and other methods described and disclosed herein.

The term "processing solution" means any aqueous solution that, once applied to a photographic element of the present invention, will initiate development of the silver halide of said element. Such a processing solution may be an alkaline developing solution, it may be an alkaline solution, it may be a simple solution of an activator like hydrogen peroxide or hydroxyl amine. Such a processing solution may be a developer solution; it may be an activator solution. An "activator" comprises a chemical agent that stimulates a development process by some chemical means. Typical activators comprise alkali, dinucleophiles such as hydroxyl amine or hydrogen peroxide, and water. Typical developers comprise reducing agents, water, and nucleophiles such as hydroxide or sulfite.

Suitable methods for applying processing solution include spraying methods, atomization methods, hopper-applicator and coater-applicator methods, web-applicator methods, thin-tank and low-volume tank methods. Spraying methods of applying activator solution in the present invention include any known method of spraying wherein the volume of said solution applied per unit area of photographic element can be suitably metered and controlled. Typical methods of spraying include the methods described by Doetzel in U.S. Pat. No. 2,158,817 and by Mayer in U.S. Pat. No. 2,404,138, where said patents are incorporated herein in their entirety by reference for all that they disclose. Suitable spraying methods include the method described by Shidara in U.S. Pat. No. 4,736,221 in column 2, lines 28–59 and in FIGS. 2A and 2B of said patent, and where said patent is incorporated herein in its entirety by reference for all that it discloses. Another suitable method of spraying a controlled amount of activator solution onto a photographic element in the method of the present invention is described in Japanese Kokai Patent No. Sho 61[1986]-80150. A particularly suitable method of spraying has been described by Smith and Townley in *Photographic Science and Engineering*, volume 7, (1959) beginning on page 55; this method utilizes the Kelvin Hughes processor. A cluster of nozzles is used in this method, wherein the rate of application of processing fluid is controlled by an electrical solenoid. Droplet size is controlled by the bore of said nozzles and by the air pressure driving the spray.

Related to spraying methods are atomization methods of applying activator solution, and in the present invention, such atomization methods include any known method of atomization wherein the volume of said solution applied per unit area of photographic element can be suitably metered and controlled. Suitable atomization methods include the methods described by Shidara in U.S. Pat. No. 4,736,221 in column 4, line 35 through column 6, line 38 and described further in FIGS. 4A–5B and 7–10B. Said atomization is induced by ultrasonication. The photographic element is preferably passed through an atomization chamber that is sealed on both sides thereof so that only the photosensitized side of said element is contacted with said activator solution. Said chamber may include means for guiding the atomized solution onto the photosensitive surface of said element. The amount of said solution contacted with said element may be controlled by varying the ultrasonic frequency and by varying the power of said ultrasonication. Said atomization method also may include means for recycling atomized activating solution previously atomized, wherein said means includes means for condensing and collecting condensate. Another suitable related method is described by Shidihara in U.S. Pat. No. 4,929,975, and is incorporated herein in its entirety by reference.

Hopper-applicator and coater-applicator methods of applying activator solution in the present invention include any known method of hopper coating wherein the volume of said solution applied per unit area of photographic element can be suitably metered and controlled. Suitable hopper-coating methods include the methods described by Columbus and Palmer in U.S. patent application Ser. No. 07/735,577 filed Jul. 25, 1991 and incorporated herein in its entirety by reference for all that it discloses. Preferred methods include coaters that repeatedly and intermittently apply a uniform and small volume of activator solution onto the photosensitive side of the photographic element of the present invention wherein the rate of solution application does not exceed the maximum swell rate of the hydrophilic binder layers on the photosensitive side of said element. This preferred method leaves no liquid effluent. The coater features a delivery channel leading from a manifold chamber to a slit orifice, the channel being improved in that it contains a plurality of spaced-apart wall portions connecting the opposed flow surfaces of the delivery channel, that extend in a direction towards the slit orifice, and structure inside the orifice for coalescing the individual streams fed by these wall portions, into a continuous strip of liquid to be dispensed by the slit orifice. Another preferred method of coating a controlled amount of activator solution onto a photographic element in the method of the present invention is described in Japanese Kokai Patent No. Sho 61[1986]-80149.

A web-applicator method suitable according to the present invention for the application of processing fluid to photographic elements has been described by Schreck in *Photographic Science and Engineering*, volume 4, 1960, beginning on p. 298, and by Hersh and Smith in *Photographic Science and Engineering*, volume 5, No. 1, January–February 1961, on pp. 50–51. This web-applicator method uses a saturated web comprising a suitable absorbent mat or web material acting as an intermediate carrier for the activator or developer. Said web comprises very short fibers of extremely small diameter (0.5–1 $\mu$m) bonded to a nonporous film base. Said web is presaturated with processing fluid and subsequently brought into surface-to-surface contact with a photographic element. The time of said contact may be varied, depending on the swell time of the hydrophilic binder typically contained in said elements, the composition of said activator, temperature, etc.

A porous-plate applicator method suitable for the application of processing fluid to photographic elements according to the present invention has been described by Hersh and Smith in *Photographic Science and Engineering*, volume 5, No. 1, January–February 1961, on page 51.

Steiger and Furholz in U.S. Pat. No. 4,868,098 disclose a method of processing exposed photographic materials wherein an amount of processing solution is applied to the uppermost layer of said materials where said amount corresponds to not more than the swelling volume of said materials, and thereafter said material is subjected to a heat treatment. The disclosure of this patent is incorporated herein by reference for all that it teaches about processing.

Another very useful coater-applicator or web-applicator method for the present invention is described by Vaughan in U.S. Pat. No. 4,945,934, the disclosure of which is incorporated herein by reference in its entirety. The activator solution is pumped to a hopper which wets a pliable web having defined on one of its surfaces a plurality of protrusions which define interconnected fluid reservoirs and distribution channels, and which are in surface-to-surface contact with the photosensitive side of the photographic elements of the present invention. Activator solution is transferred from said web to said element during the time said web and element are contacted under opposing web transport conditions. Typically, said element is transported past a stationary web.

Boie et al. in U.S. Pat. No. 4,399,212 disclose a method for processing photographic sheet material, wherein said method comprises bring said material into surface contact with a support impregnated with the required processing chemicals in the presence of the required quantity of water. This disclosure is incorporated herein by reference for all that it teaches about processing methods.

Suitable coater-applicator methods for the present invention also include those methods described and cited by Dieterle and Barbee in section XV-A of *Research Disclosure* No. 17643, page 27, December 1978, published by Industrial Opportunities Ltd., Homewell, Havant, Hampshire, England PO9 1EF. These methods include immersion or dip coating, roller coating, reverse roll coating, air knife coating, doctor blade coating, gravure coating, spray coating, extrusion coating, bead coating, stretch-flow coating, and curtain coating. Typical coating methods suitable for use in the present invention are described by Bequin in U.S. Pat. No. 2,681,294, by Beck in U.S. Pat. No. 2,815,307, by Tyler et al. in U.S. Pat. No. 2,956,494, by Takats in U.S. Pat. No. 3,081,687, by Greiller in U.S. Pat. No. 3,632,374, by Alderman and Stievenart in U.S. Pat. No. 3,641,911, by Mason and Osman in U.S. Pat. No. 4,119,990, by Hensel et al. in U.S. Pat. No. 4,332,454, by Vackler. in U.S. Pat. No. 4,480,907, by Geyken et al. in U.S. Pat. No. 4,577,949, by Kanzaki and Ohba in U.S. Pat. No. 4,875,067, by Keable and Bostic in U.S. Pat. No. 5,047,795, and by Wada in U.S. Pat. No. 5,079,580, the disclosures of which are incorporated herein by reference in their entirety.

Thin-tank methods of applying activator solution in the present invention include any known method of applying activator solution to the photosensitive side of a photographic element wherein the volume of said solution applied per unit area of photographic element can be suitably metered and controlled. Suitable thin-tank methods include the methods described by Iwano in Japanese Kokai Patent No. Sho 64[1989]-44938 (Feb. 17, 1989) and in U.S. Pat. No. 4,954,425, the disclosure of which is incorporated herein by reference. Other suitable thin-tank methods include the methods described by Vanhorebeek et al. in U.S. Pat. No. 4,327,988, by Becheiraz in U.S. Pat. No. 4,354,755, by Acklin and Rossier in U.S. Pat. No. 4,490,030, by Schar in U.S. Pat. No. 4,647,173, and by Takabayashi et al. in U.S. Pat. No. 5,043,756, the disclosures of which are incorporated herein by reference. Activator solution is applied to the photosensitive side of the element of the present invention to a thickness of 1–2 mm. Related laminar flow methods such as described in Japanese Kokai Patent No. Sho 61[1986]-77851 are particularly useful in the method of the present invention. In one such method, a quantity of activator solution is contacted with the photosensitive side of an element of the present invention so that said solution will flow in a laminar fashion or that said solution will remain stationary. Such use is essentially a single-use of said quantity. This contacting can, for example, be done in the space between concentric revolving drums, wherein the photosensitive element is attached to the inner surface of the outer drum, such that the photosensitive side faces the inner drum and a small space exists between said element and the outer surface of said inner drum. Another suitable thin-tank method of applying processing fluid according to the present invention is described by Hersh and Smith in *Photographic Science and Engineering*, volume 5, No. 1, January–February 1961, p. 49, right column, and FIG. 3 therein, where fluid cells or chambers may be used to contain processing fluids for direct application to photographic elements. Pressurized air and vacuum are applied to contact the emulsion side of said elements with a processing fluid for a desired contact time, usually on the order of a few seconds.

A thin-film method of processing suitable for the present invention has been described by Orlando in U.S. Pat. No. 2,856,829 and in *Photographic Science and Engineering*, volume 2, beginning on page 142. In this method the processing fluid is drawn from a reservoir across the photographic element by a vacuum. The processing chamber is sufficiently shallow so as to allow only a thin film of fluid between a wall of said chamber and said element.

A thin-film method utilizing a porous roller-applicator of processing suitable for the present invention has been described by Seymour in *Photographic Science and Engineering*, volume 2, 1958, beginning on page 50, and is incorporated herein by reference. The use of nonporous roller-applicators as described by Hersh and Smith in *Photographic Science and Engineering*, volume 5, No. 1, January–February 1961, pp. 51–52 is also suitable for the present invention as a method of applying processing fluid to photographic elements.

Another thin-film method of processing suitable for the present invention has been described by Hersh and Smith in *Photographic Science and Engineering*, volume 5, on page 50, wherein the activator or developer is applied in the form of a viscous solution. The residue from such application may be removed subsequent to processing or may be allowed to remain and dry on the element. Other methods of applying viscous processing solutions suitable for the present invention wherein belts and foils are used in modified web-applicator methods have also been described by Hersh and Smith in *Photographic Science and Engineering*, volume 5, on page 52. Another suitable method for applying a viscous processing solution is described by Netz et al. in U.S. Pat. No. 5,034,767, the disclosure of which is incorporated herein in its entirety by reference. Various processing solutions are suitably applied by extrusion coaters. Viscous processing solutions are preferably limited in applied volume by passing an element of the methods of the present invention through gapped rollers, wherein said gapped rollers control the coverage of said viscous processing solution on elements of the methods of the present invention. An auxiliary cover sheet or second dimensionally stable support may be laminated over an element of the methods of the present invention for the purpose of controlling evaporation or for the purpose of limiting the applied volume of processing solution in contact with said element. Preferred elements of the present invention do not utilize such a cover sheet or a second dimensionally stable support, because it is advantageous to keep the handling of the elements of the present invention simple and unencumbered by lamination and delamination steps attendant to the use of such auxiliary cover sheets and second dimensionally stable supports.

The chromogenic photographic elements of the present invention may be of any known type, so long as said elements contain radiation sensitive silver halide and an incorporated developer or developer precursor in reactive association with one another. Particularly preferred elements of the present invention contain, in addition to said silver halide and incorporated developer or incorporated developer precursor, one or more overcoat layers devoid of said silver halide and devoid of said incorporated developer or incorporated developer precursor. Said overcoat layers serve an important function in contributing to the boundary control of developer diffusion. We have made the surprising discovery that said overcoat layers, when coated at a thickness in hydrophilic binder, preferably gelatin, corresponding to about 3 $g/m^2$ or greater, establish a de facto quiescent boundary layer that retards any washout diffusional flux of developer or developer precursor during the development of said element, when said element is processed by contacting said element to a large volume processing bath. It is preferred that such thickness in hydrophilic binder be 5 $g/m^2$ or greater, since such a thickness provides robust boundary layer control in baths that have considerable agitation. It is preferred that such thickness in hydrophilic binder be less than 50 $g/m^2$, so as to minimize the cost of hydrophilic binder coated in the overcoat layer of the elements of the present invention. It is more preferred that such a thickness in hydrophilic binder be 10 $g/m^2$ or greater to provide even more robust boundary layer control in baths that have agitation. It is preferred that such a thickness in hydrophilic binder be in the range of 3–50 $g/m^2$, or more preferably in the range of 10–50 $g/m^2$, so as to provide robust boundary layer control in baths having agitation and to cap the amount and corresponding expense of hydrophilic binder in the overcoat layers of the elements of the present invention.

In preferred embodiments of the elements of the present invention, water-insoluble polymeric latex particles are incorporated in the contiguous overcoat layer or layers. Such latex particles have numerous useful purposes, including matting, UV absorbing, and controlling of curl forces at various humidities. It is preferred that such particles, when not used for matting, have volume mean diameters of less than 100 nm so as to minimize light scattering. It is more preferred that such particles, when not used for matting, have volume mean diameters of less than 60 nm so as to cause even less light scattering. It is preferred, when used for curl control, that such water-insoluble latex particle be present in the contiguous overcoat layers at a level greater than 0.5 $g/m^2$.

The composition of such latex particles may be varied without limitation, other than that the constituent polymer must be insoluble in an aqueous-based coating slurry. The preparation of such latexes is described in numerous texts, journal articles and reviews, and in many, many U.S. Patents. Examples of suitable latex compositions and preparative techniques are described in U.S. Pat. Nos. 2,269,158, 2,500,023, 2,772,163, 3,418,127, 3,518,088, 3,619,195, 3,898,088, 3,926,436, 3,944,42, 4,474,870, 4,544,723, and 5,234,807, the disclosures of which are incorporated herein in their entirety for all they teach about the preparation of latex particles, matte beads, etc. In preferred embodiments of the present invention containing such water-insoluble polymeric latexes, these polymeric latexes comprise polystyrene or polystyrene derivative. In other preferred embodiments of the present invention containing such water-insoluble polymeric latexes, these polymeric latexes comprise polymethacrylate, polyacrylate, polyacrylamide, or alkyl or halogen derivatives of polymethacrylate, polyacrylate, polyacrylamide, or polyalkylacrylamide.

The incorporated developers and incorporated developer precursors of the present invention may be of any type known in the art. Suitable developers for use in the method of the present invention include dihydroxybenzenes, aminophenols, paraphenylenediamines, and pyrazolidinones. Said developing agents are preferably selected from the group comprising 4-amino-N,N-diethylaniline hydrochloride; 4-amino-3-methyl-N,N-diethyl aniline; 4-amino-3-methyl-N-ethyl-N-(β-methanesulfon-amidoethyl)aniline; 4-amino-3-methyl-N-ethyl-N-(β-hydroxyethyl)aniline; 4-amino-3-(β-methane sulfonamido)ethyl-N,N-diethylaniline; 4-amino-3-methyl-N-ethyl-N-(β-methanesulfonamido-ethyl)aniline; and 4-amino-3-methyl-N-ethyl-N-(2-methoxy-ethyl)aniline.

Suitable developer precursors for use in the method of the present invention include those compounds disclosed by Texter et al. in U.S. application Ser. No. 07/810,232 filed Dec. 19, 1991 and incorporated herein in its entirety by reference for all that it discloses and those compounds disclosed by Southby et al. in U.S. application Ser. No. 07/810,944 filed Dec. 19, 1991 and incorporated herein in its entirety by reference for all that it discloses. In particular, said suitable compounds include compounds 1–53 disclosed in Tables I–III on pages 11–18 of U.S. application Ser. No. 07/810,232 and on pages 9–16 of U.S. application Ser. No. 07/810,944.

Preferred precursors of photographically useful organic compounds (PUC) of the present invention have a structure according to formula (I):

$$\text{PUC}—(\text{T})_m—\text{S} \qquad \text{(I)}$$

in which PUC is a photographically useful organic compound, T is a timing group, m is an integer from 0 to 6 and denotes the number of timing groups connected in series, and S is a blocking group. The blocking group S must have appropriate hydrolysis kinetics in that it must be a group that completely unblocks in the course of the development process. Preferred blocking groups S are acyl groups, particularly a β-ketoacyl group as described in U.S. Pat. No. 5,019,492, the disclosure of which is incorporated herein by reference, or a simple acyl ester as described in U.S. application Ser. No. 07/810,241 of Buchanan et al. filed Dec. 19, 1991 and incorporated herein by reference for all that it discloses. In formula (I), the timing group(s), T, may contain one or more substituents to control the aqueous solubility of the developer precursor. Exemplary timing groups are disclosed in U.S. Pat. Nos. 4,248,962, 4,741,994, 4,772,537, 4,985,336, and 5,019,492, the disclosures of which are incorporated herein by reference. Up to six timing groups can be joined sequentially in the method and element of the present invention, and m is preferably 0, 1, or 2. The m is more preferably 1 or 2, because such a combination of timing groups provides for greater overall thermal stability and release timing flexibility.

In structure (I), preferred PUC are silver halide developing agents of the primary amine type. Examples of such preferred developer precursors are illustrated in Table 1. The illustrated substituents of these blocked developers may be varied as needed, by means known in the art, in order to achieve optimized properties such as solubility, diffusibility, timing group release rate, dispensability, and developability.

In structure (I), suitable PUC include couplers such as image dye-forming couplers, development inhibitor releasing couplers, and competing couplers. Other suitable PUC include development inhibitors, bleach accelerators, dyes, dye precursors, developing agents based on hydroquinone or pyrazolone or aminophenol or phenylenediamine, silver ion fixing agents, silver halide solvents, silver halide complexing agents, image toners, image stabilizers, hardeners, tanning agents, fogging agents, nucleating agents, ultraviolet absorbing dyes, chemical sensitizing agents, bleaching agents, bleach accelerators, and desensitizers. Examples of such PUC, and precursors of such PUC, suitable for the elements of the present invention are detailed in copending, commonly assigned U.S. application Ser. No. 08/147,430 of Buchanan et al. filed Nov. 5, 1993 and in U.S. Pat. No. 4,734,353, the disclosures of which are incorporated herein by reference for all they teach about PUC and PUC precursors, and especially for what they teach about the preparation of such PUC and PUC precursors and the incorporation of such PUC and PUC precursors in photographic elements.

TABLE 1

Examples of Developer Precursors

DP1

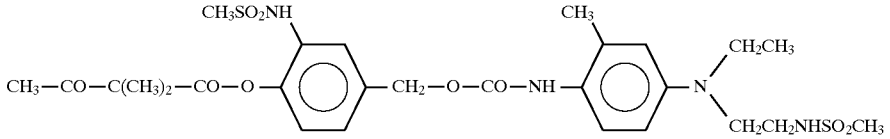

DP2

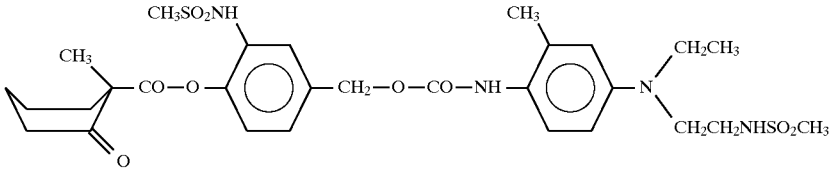

DP3

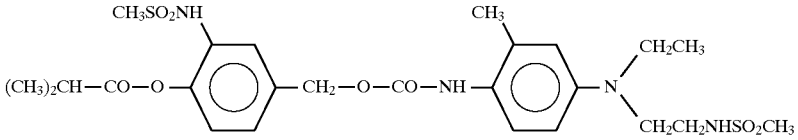

DP4

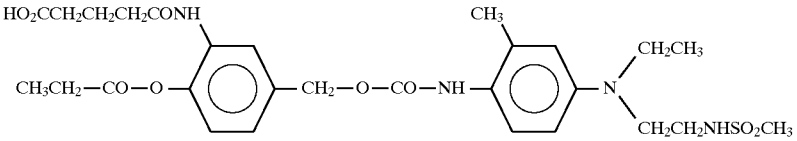

DP5

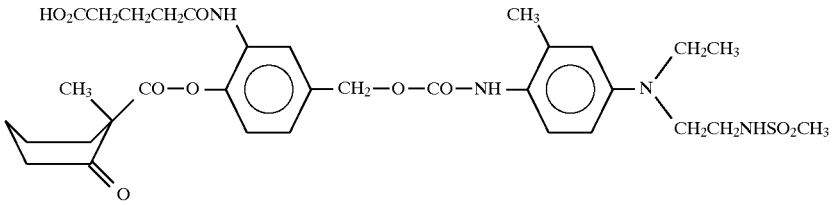

DP6

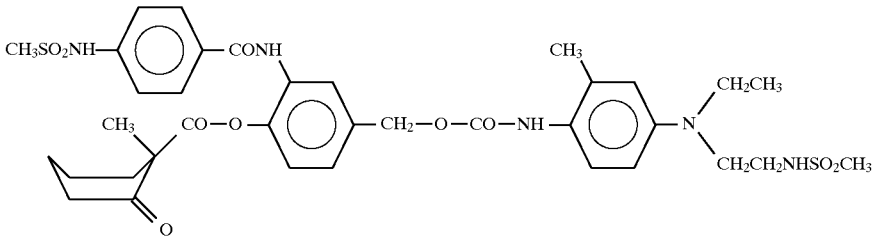

TABLE 1-continued

| Examples of Developer Precursors | |
|---|---|
| DP7 | 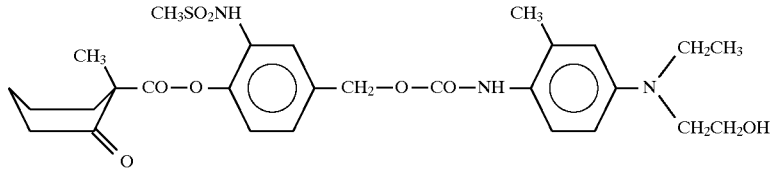 |
| DP8 | 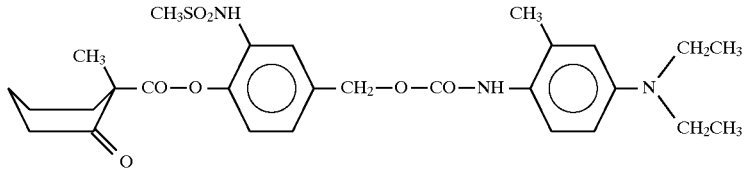 |

The incorporated PUC and incorporated PUC precursor of the present invention are incorporated at levels suitable for obtaining the dye-densities, stabilities, tone, image quality, and image structure desired in any particular combination of element and process. Suitable levels of incorporation of these PUC and PUC precursors are in the range of 0.0001–5 mole PUC or PUC precursor per mole of incorporated silver halide. The preferred level varies with the particular PUC, form of PUC precursor, and application. A range of 0.4–1 mole per mole of incorporated silver halide is preferred when PUC is a color developing agent and when maximum dye-forming efficiency is desired and granularity suppression is not a concern.

In preferred embodiments of the present invention, the elements of the present invention are devoid of incorporated base or incorporated base-releasing compound. Such elements have lower activation to unwanted thermally activated base-catalyzed hydrolysis reactions, that can cause unwanted premature release of blocking groups. Elements of the present invention may contain incorporated base or incorporated base-releasing compounds, when such incorporation facilitates some aspect of the image forming, fixing, bleaching, or stabilization process encountered in the exposure, development, and stabilization of such an element.

In preferred embodiments of the elements of the present invention, the aqueous diffusible photographically useful organic compound or precursor to said aqueous diffusible photographically useful organic compound has an effective diffusion coefficient in aqueous swollen gelatin of greater than $5\times10^{-7}$ $cm^2$ $s^{-1}$. This diffusibility ensures that the PUC or PUC precursor will adequately be in reactive association with the various parts of the coated photographic element during processing. Means for determining diffusion coefficients in such elements are detailed by H. Iwano in an article entitled The Penetration Rate of Photographic Chemicals into Gelatin Layers and into Emulsion Layers under Development, published in *The Journal of Photographic Science*, volume 20, pages 135–142, 1972.

In preferred embodiments of the elements of the present invention, the aqueous diffusible photographically useful compound or precursor to said aqueous diffusible photographically useful compound has greater than 0.5% w/w solubility in water at a pH between 2 and 12. This solubility limitation ensures that the PUC or PUC precursor will adequately be in reactive association with the various parts of the coated photographic element during processing.

Preferred processing solutions of the present invention comprise at least two components, wherein one component is water, and at least one additional component is present at a molar concentration in excess of $10^{-6}$ moles per liter. Processing solutions of the method of the present invention may be any known aqueous solution that activates and causes the initiation of development of silver halide contained in elements of the present invention. Typical processing solutions may be any known aqueous solution containing a reducing agent; preferred reducing agents are those described earlier: 4-amino-N,N-diethylaniline hydrochloride; 4-amino-3-methyl-N,N-diethyl aniline hydrochloride; 4-amino-3-methyl-N-ethyl-N-(β-methanesulfonamidoethyl)aniline sulfate hydrate; 4-amino-3-methyl-N-ethyl-N-(β-hydroxyethyl)aniline sulfate; 4-amino-3-(β-methane sulfonamido)ethyl-N,N-diethylaniline hydrochloride; 4-amino-3-methyl-N-ethyl-N-(β-methanesulfonamidoethyl)aniline sesquisulfate monohydrate; and 4-amino-3-methyl-N-ethyl-N-(2-methoxyethyl)aniline di-p-toluenesulfonic acid.

Processing solutions of the methods of the present invention preferably are aqueous solutions. Suitable processing solutions contain alkali hydroxides or other basic compounds that yield alkaline pH. Preferred pH of said processing solutions, when said solutions comprise hydroxides or other bases, is in the range of 8–14, and most preferably in the range of 9–12.

Processing solutions of the methods of the present invention also typically contain nucleophiles such as sulfite, sulfate, and hydroxide, and preferably contain, when the element of the present invention contains PUC precursors according to formula (I), dinucleophiles. Suitable dinucleophiles for the method of the present invention are described in U.S. Pat. Nos. 5,019,492 and 5,210,007 and U.S. application Ser. No. 07/810,322 of Texter et al. filed Dec. 19, 1992 and incorporated herein in their entirety by reference for all they disclose. Preferred dinucleophiles are those described according to formula (I) of U.S. application Ser. No. 07/810,322 on page 5 line 20 through page 6, line 7 therein. Hydrogen peroxide, hydroxyl amine, and α-amino acetic acid are examples of preferred dinucleophiles.

Suitable processing solutions of the methods of the present invention have viscosities less than 50 cP to enable smooth and rapid application by the applicator methods of the present invention. It is preferred that the processing solutions of the methods of the present invention have viscosities less than 10 cP to enable even more rapid application.

Dispersions of any of the photographically useful compounds incorporated in the elements of the present invention may be obtained by any of the methods for imparting mechanical shear well known in the art, such as those methods described in U.S. Pat. Nos. 2,581,414 and 2,855,156 and in Canadian Patent No. 1,105,761, the disclosures of which are incorporated herein by reference. These methods include solid-particle milling methods such as ball-milling, pebble-milling, roller-milling, sand-milling, bead-milling, dyno-milling, Masap-milling, and media-milling. These methods further include colloid milling, milling in an attriter, dispersing with ultrasonic energy, and high speed agitation (as disclosed by Onishi et al. in U.S. Pat. No. 4,474,872 and incorporated herein by reference). Ball-milling, roller-milling, media-milling, and milling in an attriter are preferred milling methods because of their ease of operation, cleanup, and reproducibility.

Alternatively, dispersions of photographically useful compounds of the present invention may be prepared wherein these photographically useful compounds are present in an amorphous physical state and may be prepared by well known methods including colloid milling, homogenization, high speed stirring, and sonication methods.

In the following discussion of suitable materials for use in the emulsions and elements according to the invention, reference will be made to *Research Disclosure*, December 1989, Item 308119, published by Kenneth Mason Publications Ltd., Emsworth, Hampshire P010 7DQ, U.K., the disclosures of which are incorporated in their entireties herein by reference. This publication will be identified hereafter as "*Research Disclosure*".

The support of the element of the invention can be any of a number of well known supports for photographic elements. These include polymeric films, such as cellulose esters (for example, cellulose triacetate and diacetate) and polyesters of dibasic aromatic carboxylic acids with divalent alcohols (such as polyethylene terephthalate), paper, and polymer-coated paper.

The photographic elements according to the invention can be coated on the selected supports as described in *Research Disclosure* Section XVII and the references cited therein.

The radiation-sensitive layer of a photographic element according to the invention can contain any of the known radiation-sensitive materials, such as silver halide, or other light sensitive silver salts. Silver halide is preferred as a radiation-sensitive material. Silver halide emulsions can contain, for example, silver bromide, silver chloride, silver iodide, silver chlorobromide, silver chloroiodide, silver bromoiodide, or mixtures thereof. The emulsions can include coarse, medium, or fine silver halide grains bounded by 100, 111, or 110 crystal planes. Emulsions containing more than 70 mole percent silver chloride are preferred because they are susceptible to rapid processing methods and speedy development processes. Emulsions containing more than 95 mole percent silver chloride are most preferred because they are most susceptible to rapid processing methods and speedy development processes.

The silver halide emulsions employed in the elements according to the invention can be either negative-working or positive-working. Suitable emulsions and their preparation are described in *Research Disclosure* Sections I and II and the publications cited therein.

Also useful are tabular grain silver halide emulsions. In general, tabular grain emulsions are those in which greater than 50 percent of the total grain projected area comprises tabular grain silver halide crystals having a grain diameter and thickness selected so that the diameter divided by the mathematical square of the thickness is greater than 25, wherein the diameter and thickness are both measured in microns. An example of tabular grain emulsions is described in U.S. Pat. No. 4,439,520. Suitable vehicles for the emulsion layers and other layers of elements according to the invention are described in *Research Disclosure* Section IX and the publications cited therein. The radiation-sensitive materials described above can be sensitized to a particular wavelength range of radiation, such as the red, blue, or green portions of the visible spectrum or to other wavelength ranges, such as ultraviolet infrared, X-ray, and the like. Sensitization of silver halide can be accomplished with chemical sensitizers such as gold compounds, iridium compounds, or other group VIII metal compounds, or with spectral sensitizing dyes such as cyanine dyes, merocyanine dyes, or other known spectral sensitizers. Exemplary sensitizers are described in *Research Disclosure* Section IV and the publications cited therein.

Multicolor photographic elements according to the invention generally comprise a blue-sensitive silver halide layer having a yellow color-forming coupler associated therewith, a green-sensitive layer having a magenta color-forming coupler associated therewith, and a red-sensitive silver halide layer having a cyan colorforming coupler associated therewith. Color photographic elements and color-forming couplers are well-known in the art. The elements according to the invention can include couplers as described in *Research Disclosure* Section VII, paragraphs D, E, F and G and the publications cited therein. These couplers can be incorporated in the elements and emulsions as described in *Research Disclosure* Section VII, paragraph C and the publications cited therein.

A photographic element according to the invention, or individual layers thereof, can also include any of a number of other well-known additives and layers. These include, for example, optical brighteners (see *Research Disclosure* Section V), antifoggants and image stabilizers (see *Research Disclosure* Section VI), light-absorbing materials such as filter layers of intergrain absorbers, and light-scattering materials (see *Research Disclosure* Section VII), gelatin hardeners (see *Research Disclosure* Section X), oxidized developer scavengers, coating aids and various surfactants, overcoat layers, interlayers, barrier layers and antihalation layers (see *Research Disclosure* Section VII, paragraph K), antistatic agents (see *Research Disclosure* Section XIII), plasticizers and lubricants (see *Research Disclosure* Section XII), matting agents (see *Research Disclosure* Section XVI), antistain agents and image dye stabilizers (see *Research Disclosure* Section VII, paragraphs I and J), development-inhibitor releasing couplers and bleach accelerator-releasing couplers (see *Research Disclosure* Section VII, paragraph F), development modifiers (see *Research Disclosure* Section XXI), base compounds and base-releasing compounds such as described, for example, in U.S. Pat. Nos. 4,741,997 and 4,740,445 and in European Patent publication 210 660, the disclosures of which are incorporated herein by reference, and other additives and layers known in the art. When processing and activator solutions are used in the methods of the present invention, wherein said solutions are alkaline, it is preferred that elements of the present invention are devoid of incorporated base or base-releasing compounds, because said elements have greater storage stability. Typical elements of the present invention may contain incorporated base or base-releasing compounds when it is disadvantageous to incorporate all needed alkali in the requisite processing solution.

Photographic elements according to the invention can be exposed to actinic radiation, typically in the visible region of the spectrum to form a latent image as described in *Research Disclosure* Section XVIII, and then processed to form a visible dye image as described in *Research Disclosure* Section XIX. Processing can be any type of known photographic processing, although it is typically carried out at alkaline pH, preferably at pH 8–14, and more preferably at pH 9–12.

A negative image can be developed by using one or more of the aforementioned nucleophiles. A positive image can be developed by first developing with a nonchromogenic developer, then uniformly fogging the element, and then developing by a process employing one or more of the aforementioned nucleophiles.

Development may be followed by the conventional steps of bleaching, fixing, or bleach-fixing, to remove silver and silver halide, washing, and drying. Bleaching and fixing can be performed with any of the materials known to be used for that purpose. Bleach baths generally comprise an aqueous solution of an oxidizing agent such as water soluble salts and complexes of iron (III) (such as potassium ferricyanide, ferric chloride, ammonium or potassium salts of ferric ethylenediaminetetraacetic acid), water-soluble dichromates (such as potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thioureas, and the like.

The advantages of the present invention will become more apparent by reading the following examples. The scope of the present invention is by no means limited by these examples, however.

EXAMPLES

The effects of a diffusive overcoat in the layer structure and the effects of agitation during application of activator solution on developer/developer-precursor diffusion are examined experimentally. Two test coatings are made on a reflection support (titania-pigmented high-density polyethylene extruded onto paper base). Coating #1 is a two-layer coating. The first layer is coated upon the support is a layer of gelatin at 3.22 g/m$^2$. The second layer contains 320 mg/m$^2$ Ag (as red sensitive AgCl), 860 mg/m$^2$ of C1, a cyan dye forming coupler, 860 mg/m$^2$ DP1, and 3.22 g/m$^2$ gelatin. Coating #2 is a two-layer coating having a layer composition inverted

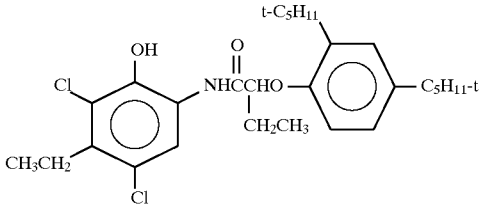

C1

-continued

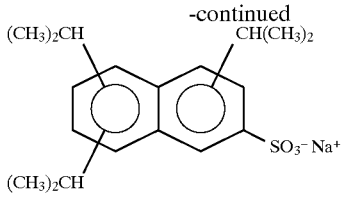

DA1 with respect to that of Coating #1. The first layer is coated upon the support and contains 320 mg/M$^2$ Ag (as red sensitive AgCl), 860 mg/m$^2$ C1, 860 mg/M$^2$ DP1, and 3.22 g/m$^2$ gelatin. The second layer is coated upon the first layer, and contains gelatin at 3.22 g/m$^2$. Hardener, in the form of 1,1'-[methylenebis(sulfonyl)]bisethene i added at a level of 1.5% (w/w) of total gelatin to crosslink the gelatin. The cyan dye-forming coupler C1 is dispersed with di-n-butyl phthalate at a weight ratio of about 1:1/2 by homogenization methods well known in the art. The developer precursor, DP1, is prepared as a colloid milled dispersion by emulsifying an ethyl acetate solution of DP1 with aqueous gelatin and dispersing aid, DA1, and thereafter removing the ethyl acetate. A red sensitized AgCl emulsion is used as the light sensitive element. These coatings are given stepped exposures and placed in an excess of activator solution (deep tank) without agitation for 90 seconds. The aqueous activator solution comprises potassium carbonate (50 g/L) adjusted to pH 11 and 0.6% (by weight) hydrogen peroxide. After development, these coatings are placed in a bleach-fix solution, washed, dried, and read by reflectance densitometry. A Dmax of 1.2 is obtained for the comparison Coating #1 and a Dmax of 1.4 is obtained for the invention example Coating #2 (Examples 1 and 2, respectively). The higher Dmax in Example 2 of the present Invention shows that overcoats not containing incorporated developer or developer precursor provide better utilization of incorporated developer or developer precursor.

Numerous modifications and variations of this invention are possible in view of the above disclosure. It is therefore understood that within the scope of the claims appended hereto, the elements of the invention may be made using all suitable modifications falling within said scope.

What is claimed is:

1. An aqueous developable chromogenic photographic element coated on a single dimensionally stable support wherein said element comprises in reactive association (1) an aqueous diffusible photographically useful organic compound or precursor to an aqueous diffusible photographically useful organic compound, (2) radiation sensitive silver halide, (3) hydrophilic binder, and (4) one or more contiguous overcoat layers devoid of silver halide wherein said one or more overcoat layers comprise hydrophilic binder at a level greater than 10 g/m$^2$.

2. An element as in claim 1, wherein said one or more overcoat layers comprise hydrophilic binder at a level of less than 50 g/m$^2$.

3. An element as in claim 1, wherein said one or more overcoat layers comprise hydrophilic binder at a level greater than 10 g/m$^2$ and less than 50 g/m$^2$.

4. An element as in claim 1, wherein said hydrophilic binder in said one or more contiguous overcoat layers comprises gelatin.

5. An element as in claim 1, wherein said silver halide comprises greater than 95 mole percent silver chloride.

6. An element as in claim 1, further comprising in reactive association a compound that forms or releases a dye.

7. An element as in claim 1, wherein said photographically useful organic compound is an aminophenol or paraphenylenediamine developing agent or a precursor of an aminophenol or paraphenylenediamine developing agent.

8. An element as in claim 1, wherein said precursor to an aqueous diffusible photographically useful organic compound has a structure according to formula (I):

$$PUC—(T)_m—S \quad (I)$$

in which PUC is a photographically useful organic compound, T is a timing group, m is an integer from 0 to 6 and denotes the number of timing groups connected in series, and S is a blocking group.

9. An element as in claim 8, wherein said PUC is a silver halide developing agent.

10. An element as in claim 1, wherein said aqueous diffusible photographically useful organic compound or precursor to said aqueous diffusible photographically useful organic compound is incorporated in said element at a level of 0.0001–5 mole per mole of said silver halide.

11. An element as in claim 1, wherein said element is devoid of incorporated base or incorporated base-releasing compound.

12. An element as in claim 1, wherein said aqueous diffusible photographically useful organic compound or precursor to said aqueous diffusible photographically useful organic compound has an effective diffusion coefficient in aqueous swollen gelatin of greater than $5\times10^{-7}$ $cm^2$ $S^{-1}$.

13. An element as in claim 1, wherein said aqueous diffusible photographically useful compound or precursor to said aqueous diffusible photographically useful compound has greater than 0.5% w/w solubility in water at a pH between 2 and 12.

14. An element as in claim 1, wherein said contiguous overcoat layers additionally comprise water-insoluble polymeric latex particles with volume mean diameter less than 100 nm.

15. An element as in claim 14, wherein said water-insoluble polymeric latex particles are present in said overcoat layers at a level greater than 2 $g/m^2$.

16. An element as in claim 14, wherein said water-insoluble polymeric latex particles have a volume mean diameter less than 60 nm.

17. An element as in claim 14, wherein said water-insoluble polymeric latex comprises polystyrene or polystyrene derivative.

18. An element as in claim 14, wherein said water-insoluble polymeric latex comprises polymethacrylate, polyacrylate, polyacrylamide, polyalkylacrylamide, or alkyl or halogen derivatives thereof.

* * * * *